US008490231B1

(12) United States Patent
Tjoflat

(10) Patent No.: US 8,490,231 B1
(45) Date of Patent: Jul. 23, 2013

(54) SYSTEMS, METHODS AND DESIGNS FOR HANDLES IN FURNITURE

(75) Inventor: Cindy Tjoflat, Tucker, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 13/006,828

(22) Filed: Jan. 14, 2011

(51) Int. Cl.
*A47C 17/00* (2006.01)

(52) U.S. Cl.
USPC ..... 5/703; 5/81.1 R; 5/81.1 HS

(58) Field of Classification Search
USPC ..... 5/703, 81.1 HS, 81.1 R
See application file for complete search history.

(56) References Cited

U.S. PATENT DOCUMENTS

| | | | | | |
|---|---|---|---|---|---|
| 274,495 | A | * | 3/1883 | Heath | 5/706 |
| 278,055 | A | * | 5/1883 | Smith | 5/703 |
| 604,043 | A | * | 5/1898 | Hall | 5/703 |
| 684,276 | A | * | 10/1901 | Lonergan | 5/703 |
| 765,756 | A | * | 7/1904 | Stratton | 5/703 |
| 897,979 | A | * | 9/1908 | Holding | 5/703 |
| 912,536 | A | * | 2/1909 | Brown | 5/703 |
| 931,024 | A | * | 8/1909 | Allen | 5/703 |
| 967,652 | A | * | 8/1910 | Michie | 5/703 |
| 1,035,222 | A | * | 8/1912 | Minchin | 5/703 |
| 1,140,043 | A | * | 5/1915 | Knickmeyer | 5/703 |
| 1,144,888 | A | * | 6/1915 | Bradshaw | 5/703 |
| 1,566,907 | A | * | 12/1925 | Mertes | 5/703 |
| 1,596,209 | A | * | 8/1926 | Mulkey | 5/703 |
| 1,709,995 | A | * | 4/1929 | Mulkey | 5/703 |
| 1,731,530 | A | * | 10/1929 | Goldeen | 5/703 |
| 2,083,361 | A | * | 6/1937 | Bronstien | 5/703 |
| 2,083,956 | A | * | 6/1937 | Lang | 16/444 |
| 2,086,489 | A | * | 7/1937 | Bewersex | 16/110.1 |
| 2,105,580 | A | * | 1/1938 | Bechik | 5/703 |
| 2,194,407 | A | * | 3/1940 | Rolstone | 5/703 |
| 2,206,087 | A | * | 7/1940 | Gladstone | 16/445 |
| 2,224,301 | A | * | 12/1940 | Johnson | 5/703 |
| 2,330,192 | A | * | 9/1943 | Bednarek | 5/703 |
| 2,435,388 | A | * | 2/1948 | Fridolph | 5/703 |
| 2,502,584 | A | * | 4/1950 | Nattenheimer | 5/703 |
| 2,630,587 | A | * | 3/1953 | Brown | 5/496 |
| 2,662,235 | A | * | 12/1953 | Ferguson | 5/703 |
| 2,715,229 | A | * | 8/1955 | Hirschman | 5/703 |
| RE24,386 | E | * | 11/1957 | Bechik | 5/703 |
| 2,860,353 | A | * | 11/1958 | Byer | 5/703 |
| 2,974,326 | A | * | 3/1961 | Ross | 5/255 |
| 2,982,977 | A | * | 5/1961 | Caster | 5/703 |
| 3,096,529 | A | * | 7/1963 | Thompson | 5/703 |
| 3,176,326 | A | * | 4/1965 | Zysman et al. | 5/703 |
| 3,254,349 | A | * | 6/1966 | Bronstien, Sr. | 5/703 |
| 3,254,350 | A | * | 6/1966 | Bronstien, Sr. | 5/703 |
| 3,254,351 | A | * | 6/1966 | Bronstien, Sr. | 5/703 |
| 3,261,036 | A | * | 7/1966 | Bronstien, Sr. | 5/703 |
| 3,285,404 | A | * | 11/1966 | Spinney | 206/526 |
| 3,289,224 | A | * | 12/1966 | Witchel | 5/703 |
| 3,302,221 | A | * | 2/1967 | Zysman | 5/703 |
| 3,514,797 | A | * | 6/1970 | Zysman | 5/703 |
| 3,590,405 | A | * | 7/1971 | Kerr | 5/703 |
| 3,626,525 | A | * | 12/1971 | Fasanella | 5/703 |

(Continued)

*Primary Examiner* — Robert G Santos
*Assistant Examiner* — Brittany Wilson
(74) *Attorney, Agent, or Firm* — Cantor Colburn LLP

(57) ABSTRACT

In many aspects the systems and methods described herein provide handles for furniture and the furniture that has these improved handle systems. In particular, various embodiments include furniture handles, such as handles for mattresses, cushions, futons and the like, where the handles have a suitable shape and are disposed at select locations and orientations along one or more sidewalls and/or the sleeping surface and/or bottom surface of the mattress.

4 Claims, 28 Drawing Sheets

U.S. PATENT DOCUMENTS

| | | | | | |
|---|---|---|---|---|---|
| 3,859,679 | A | * | 1/1975 | Bartz et al. | 5/703 |
| 4,316,298 | A | * | 2/1982 | Russo et al. | 5/722 |
| 4,930,170 | A | * | 6/1990 | Kobayashi | 5/12.1 |
| 5,303,436 | A | * | 4/1994 | Dinsmoor et al. | 5/719 |
| D377,433 | S | * | 1/1997 | Funk et al. | D6/596 |
| 5,632,054 | A | * | 5/1997 | Hutton et al. | 5/692 |
| 5,860,174 | A | * | 1/1999 | Failor | 5/81.1 HS |
| 5,864,907 | A | * | 2/1999 | Hutton et al. | 5/703 |
| 5,937,463 | A | * | 8/1999 | Hutton et al. | 5/703 |
| 6,176,002 | B1 | * | 1/2001 | Korb | 29/453 |
| 6,349,432 | B1 | * | 2/2002 | Scordato et al. | 5/81.1 R |
| 7,243,382 | B2 | * | 7/2007 | Weedling et al. | 5/81.1 R |
| 7,610,640 | B2 | * | 11/2009 | Post | 5/626 |
| 7,904,979 | B2 | * | 3/2011 | Walke et al. | 5/706 |
| 7,975,330 | B2 | * | 7/2011 | Receveur et al. | 5/81.1 HS |
| 8,122,543 | B2 | * | 2/2012 | Kenalty et al. | 5/626 |
| 2007/0180612 | A1 | * | 8/2007 | Barth et al. | 5/81.1 R |
| 2012/0131750 | A1 | * | 5/2012 | Kenalty et al. | 5/626 |

* cited by examiner

SYSTEMS, METHODS AND DESIGNS FOR HANDLES IN FURNITURE

BACKGROUND

From time-to-time, consumers are required to lift and move heavy pieces of furniture either to clean it, change a foundation component or change its location. To enable such tasks, furniture pieces are generally equipped with handles. For example, mattresses often come with string/cord handles that either attach or form part of the side regions of the mattress, usually around the center, or at the ends. Even though these string handles are commonplace in mattresses and other furniture, and seem to work well, they suffer from a number of drawbacks. String handles generally need a complex assembly process that can be costly and time-consuming. String handles are typically affixed tightly to the furniture in an effort to camouflage them and make the furniture more visually appealing. However, this technique limits the handle's adjustability and can potentially be injurious to the person moving the furniture. Moreover, affixing them tightly to furniture does not always camouflage them and consequently these string handles may still have an unsightly appearance.

Accordingly, there is a need for an improved handle system for furniture. Because handles often appear on the exterior surfaces of the mattresses there is also a need for them to be visually attractive.

SUMMARY

The systems and methods described herein include improved furniture handles and improved methods for manufacturing furniture handles, such as handles for mattresses.

In one aspect, the systems and methods described herein provide handles for furniture and the furniture that has these improved handle systems. In another aspect, the systems and methods described and shown herein include ornamental designs for handles for furniture. In yet another aspect, the systems and methods described and shown herein include ornamental designs for furniture having handles. In particular, various embodiments include furniture handles, such as handles for mattresses, cushions, futons and the like, where the handles have a suitable shape, design and ornamentality, and are disposed at select locations and orientations along one or more sidewalls and/or the sleeping surface and/or bottom surface of the mattress.

BRIEF DESCRIPTION OF THE DRAWINGS

The following figures depict certain illustrative embodiments of the invention in which like reference numerals refer to like elements. These depicted embodiments may not be drawn to scale and are to be understood as illustrative of the invention and not as limiting in any way.

DETAILED DESCRIPTION OF THE DRAWINGS

These and other aspects and embodiments of the systems and methods of the invention will be described more fully by referring to the figures provided.

The systems and methods described herein will now be described with reference to certain illustrative embodiments, although the invention is not to be limited to these illustrated embodiments which are provided merely for the purpose of describing the systems and methods of the invention and are not to be understood as limiting in anyway. As will be seen from the following description, in one aspect the invention provides handles for furniture and the furniture that has these improved handle systems. In particular, the embodiments illustrated below include furniture handles, such as handles for mattresses, cushions, futons and the like, where the handles have a suitable shape and are disposed at select locations and orientations along one or more sidewalls and/or the sleeping surface and/or bottom surface of the mattress.

Figure 1A:
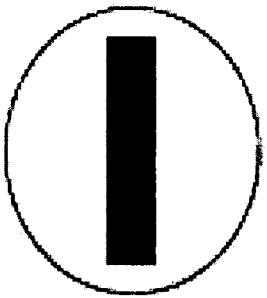
FIGS. 1A-1D depict exemplary handles that are disposed in a vertical orientation on a portion of a mattress.
Figure 1B:
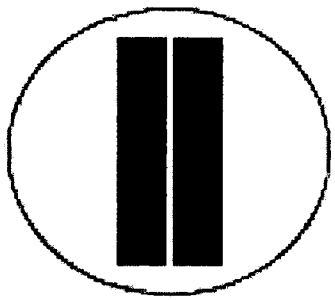
Figure 1C:
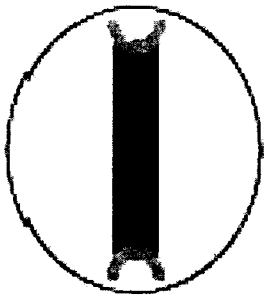
Figure 1D:
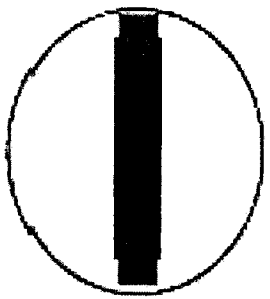

FIGS. 1A-7 depict several embodiments of handles for mattresses. FIGS. 8A-14 depict mattresses having one or more of the handles of FIGS. 1A-7. In particular, FIGS. 1A-1D depict exemplary handles that are disposed in a vertical orientation on a portion of a mattress. FIG. 1A shows a single strip of material and FIG. 1B shows two strips of materials substantially parallel to one another. FIGS. 1C and 1D shows vertical strip of material having stretchable material disposed on each end. The stretchable material may be formed from material similar to that used in bungee cords. Generally, the handles depicted in FIGS. 1A-1D may be disposed in a vertical orientation on the mattress. In one embodiment, the end portions of the handles may be stitched onto a surface of the mattress. The handles depicted in FIGS. 1A-1D may be formed from one or more materials without departing from the scope of the invention.

Figure 8A:
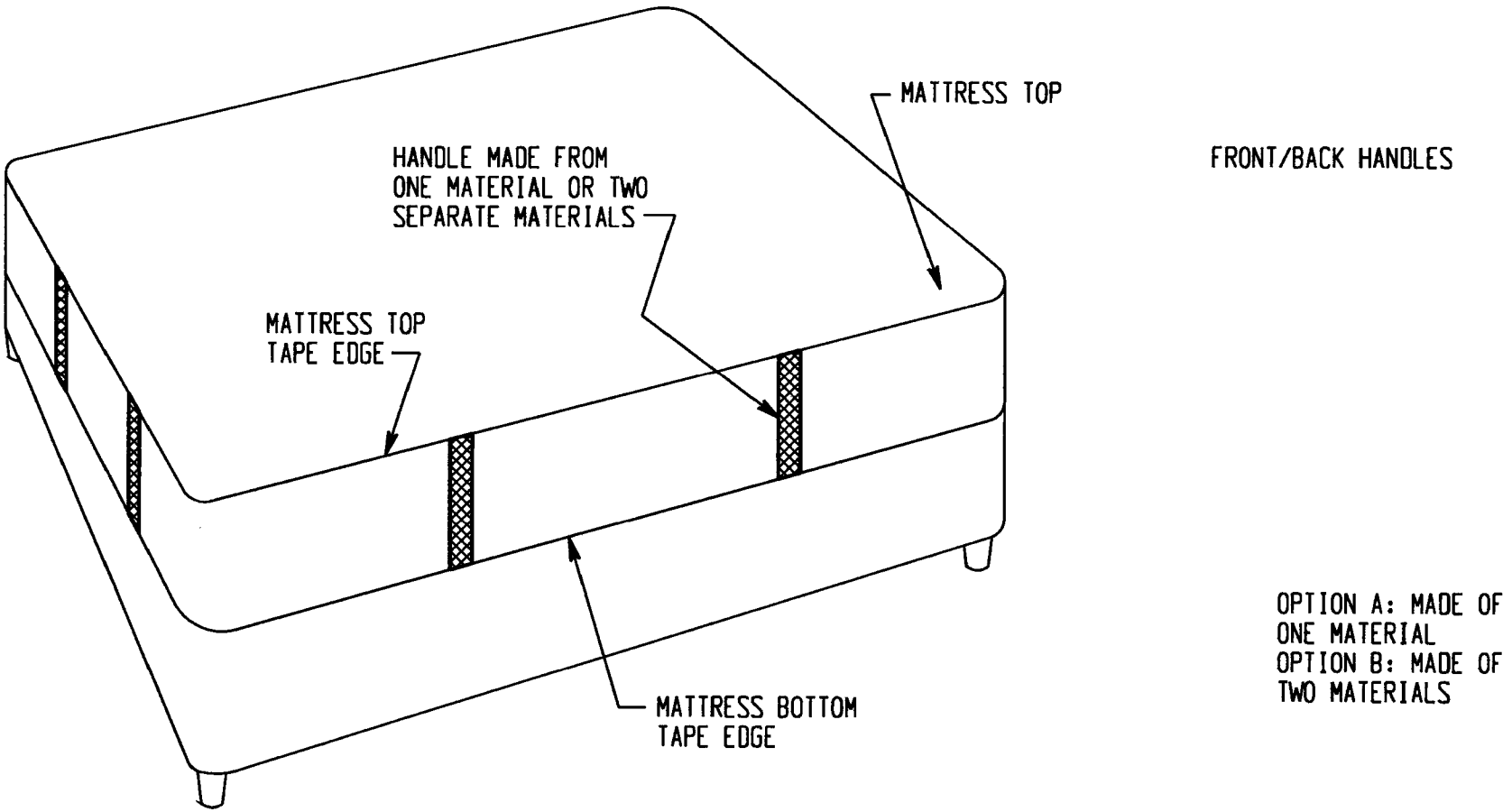
FIGS. 8A-8F depict mattresses having one or more handles depicted in FIGS. 1A-1D, according to an illustrative embodiment of the invention.
Figure 8B:
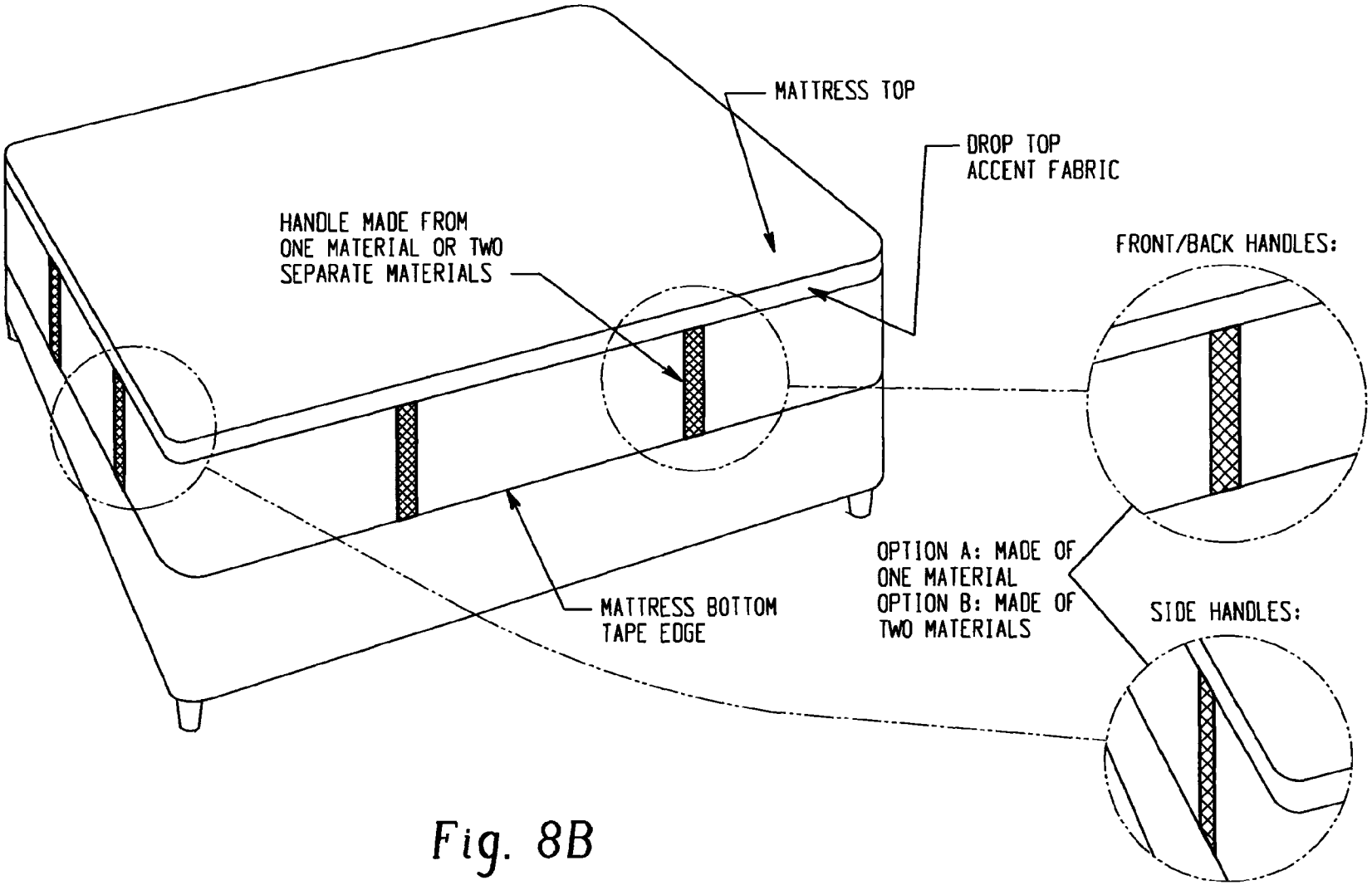
Figure 8C:
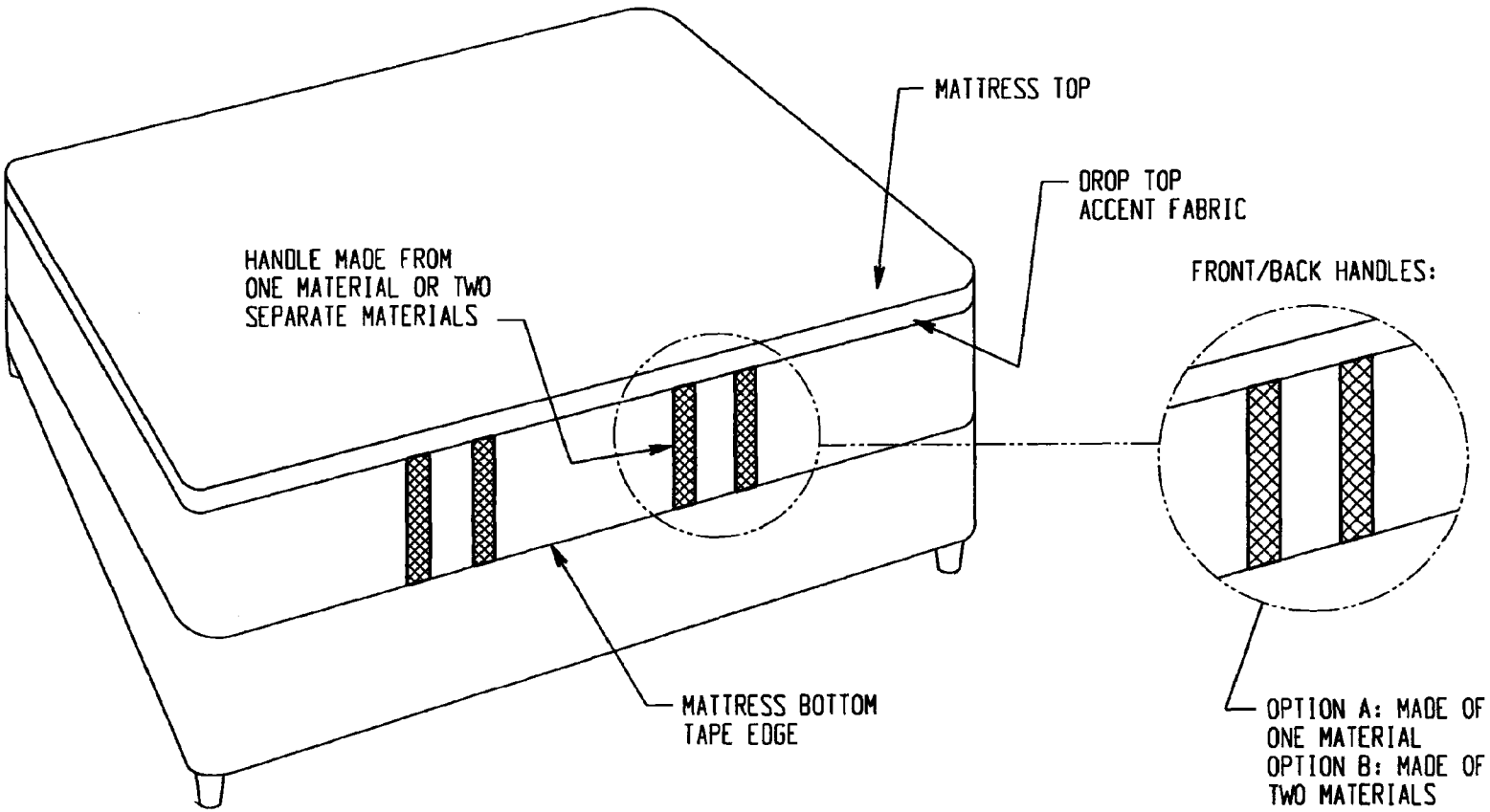
Figure 8D:
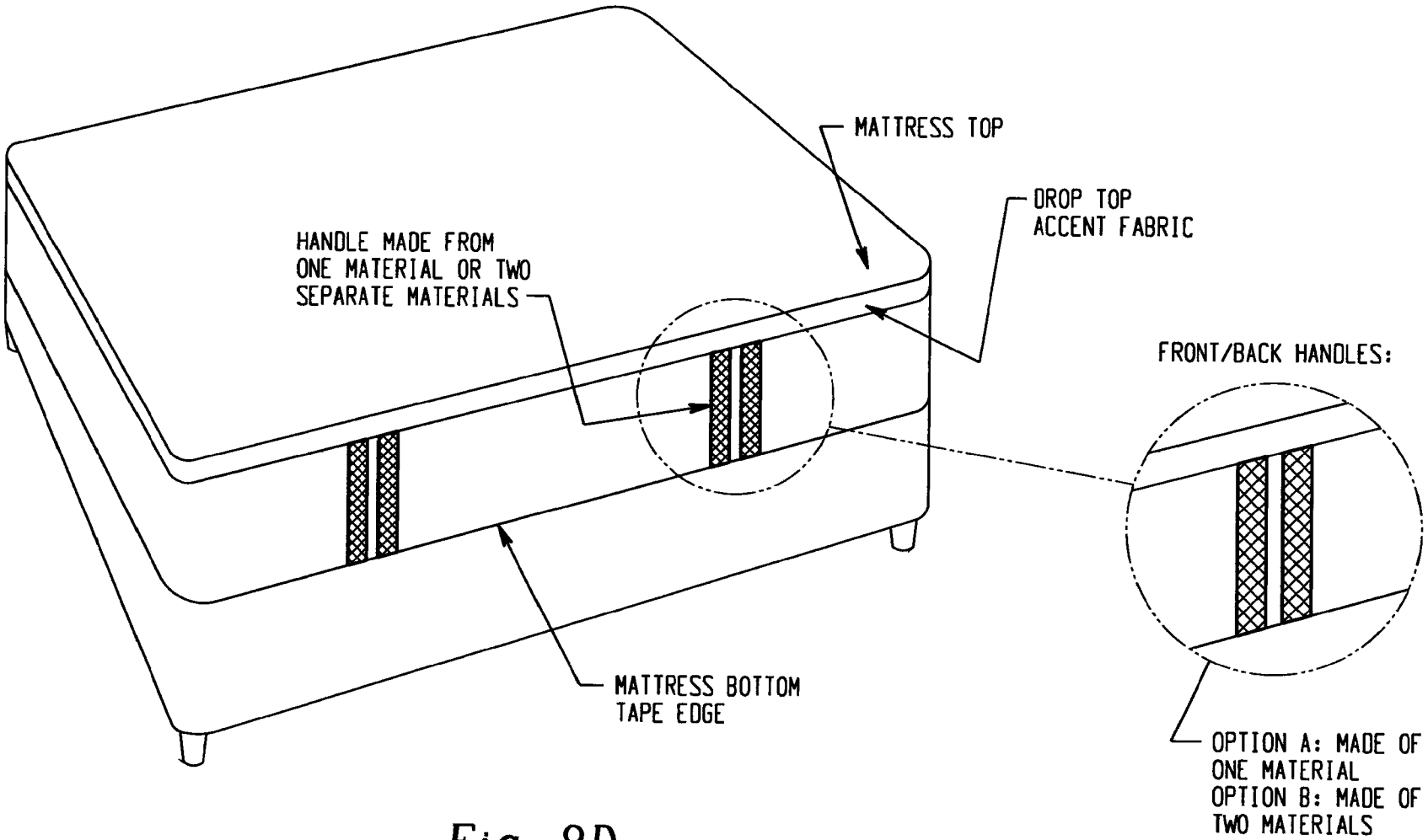
Figure 8E:
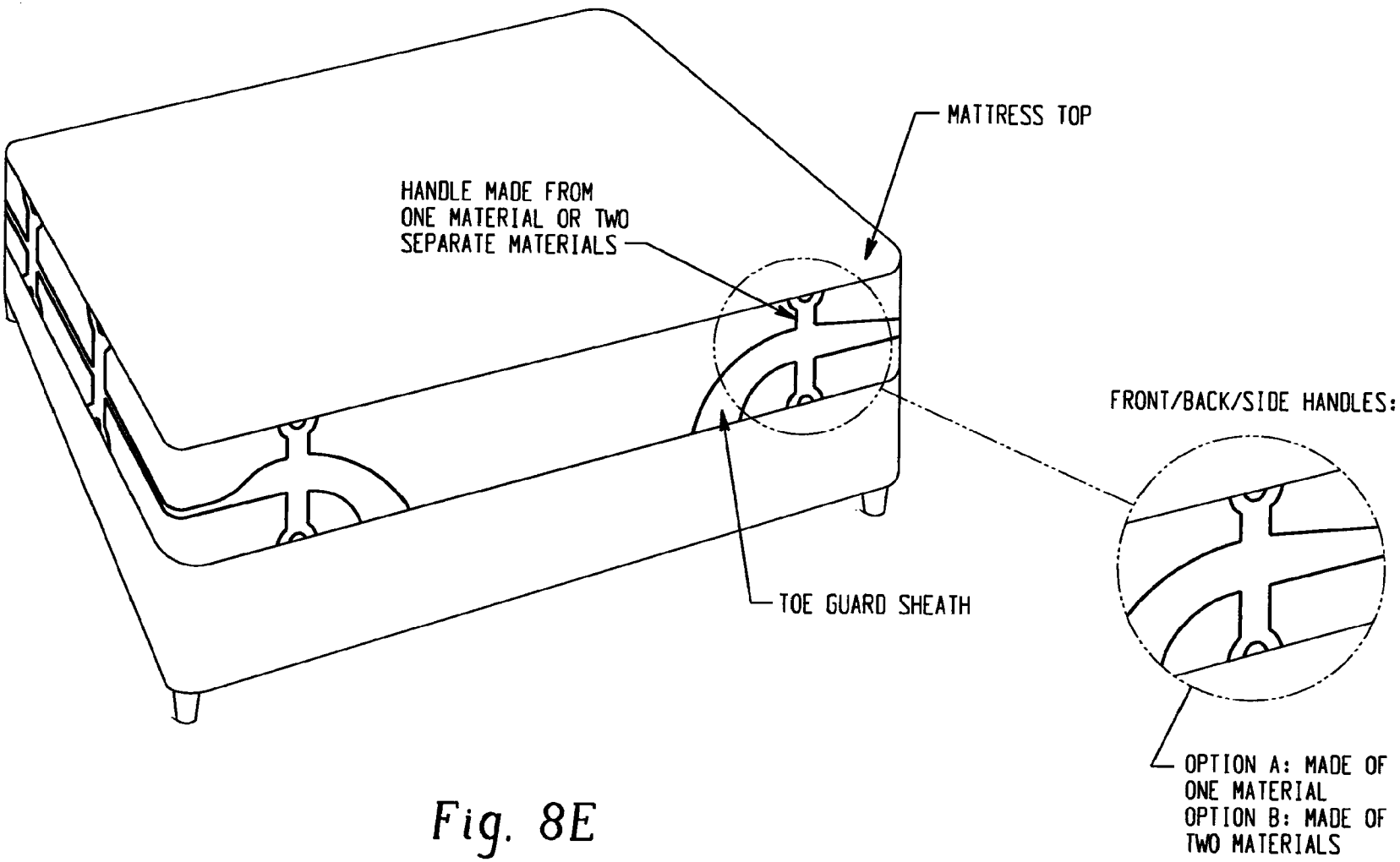
Figure 8F:
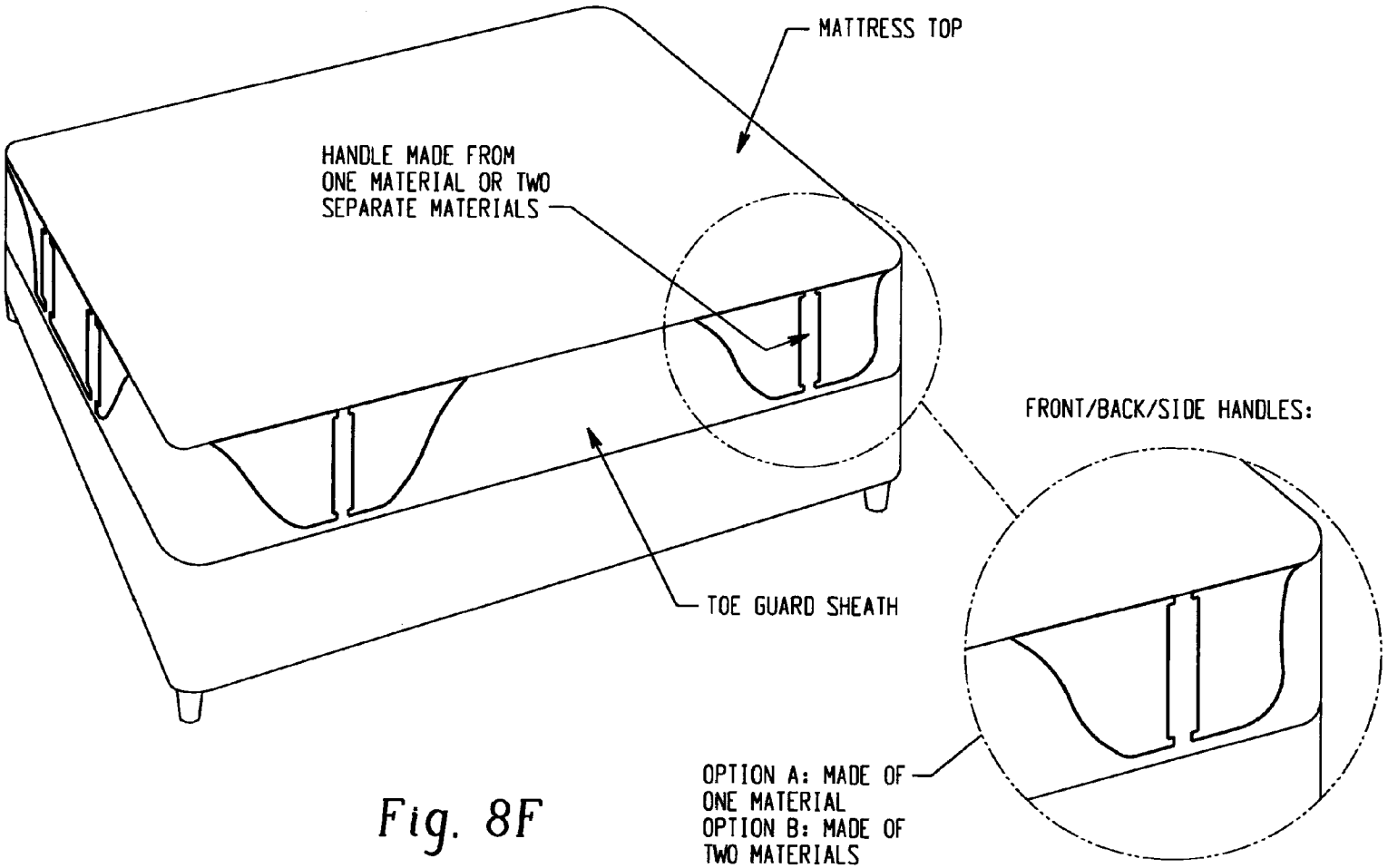

FIGS. 8A-8F depict mattresses having one or more handles depicted in FIGS. 1A-1D, according to an illustrative embodiment of the invention. FIG. 8A shows a mattress having handles of FIG. 1A on at least two side surfaces. The handle may be attached on or substantially near the top tape edge portion and the bottom tape edge portion of the mattress. FIGS. 8B and 8C shows a mattress having two or more handles of FIG. 1A on at least two side surfaces. However, in FIGS. 8B and 8C, the mattresses include a strip of fabric disposed below the top tape edge of the mattress. The handles in FIGS. 8B and 8C are attached to a portion of this strip of material. FIG. 8D shows a mattress having two handles of FIG. 1B on each of at least two side surfaces. In FIG. 8D, the mattress includes a strip of fabric disposed below the top tape edge of the mattress. The handles in FIG. 8D are attached to a portion of this strip of material. FIG. 8E shows a mattress having handles of FIG. 1C on at least two side surfaces. FIG. 8F shows a mattress having handles of FIG. 1D on at least two side surfaces. FIGS. 8E and 8F depict sheath materials disposed on the side walls.

Figures 2A, 2B, 2C:
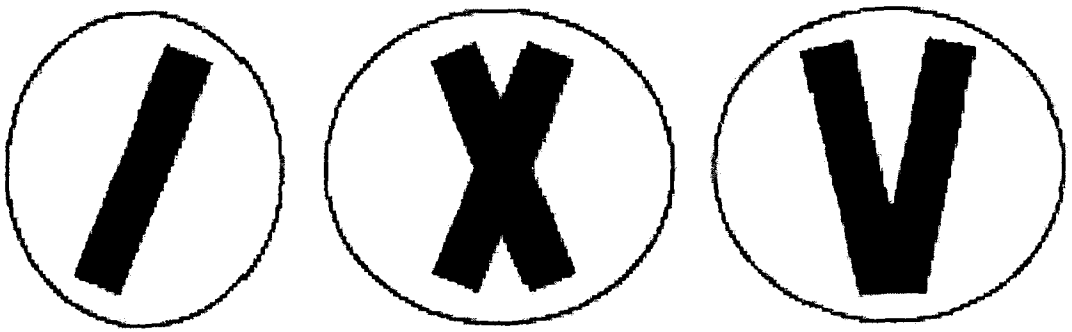
FIGS. 2A-2C depict exemplary handles that are disposed in an angled orientation on a portion of a mattress.

FIGS. 2A-2C depict exemplary handles that are disposed in an angled orientation on a portion of a mattress. In particular, FIG. 2A shows a single strip of material, FIG. 2B shows a two strips of materials crisscrossing one another, and FIG. 2C shows two strips forming a V-shape. In one embodiment, the end portions of the handles may be stitched onto a surface of the mattress. The handles depicted in FIGS. 2A-2C may be formed from one or more materials without departing from the scope of the invention.

Figure 9A:
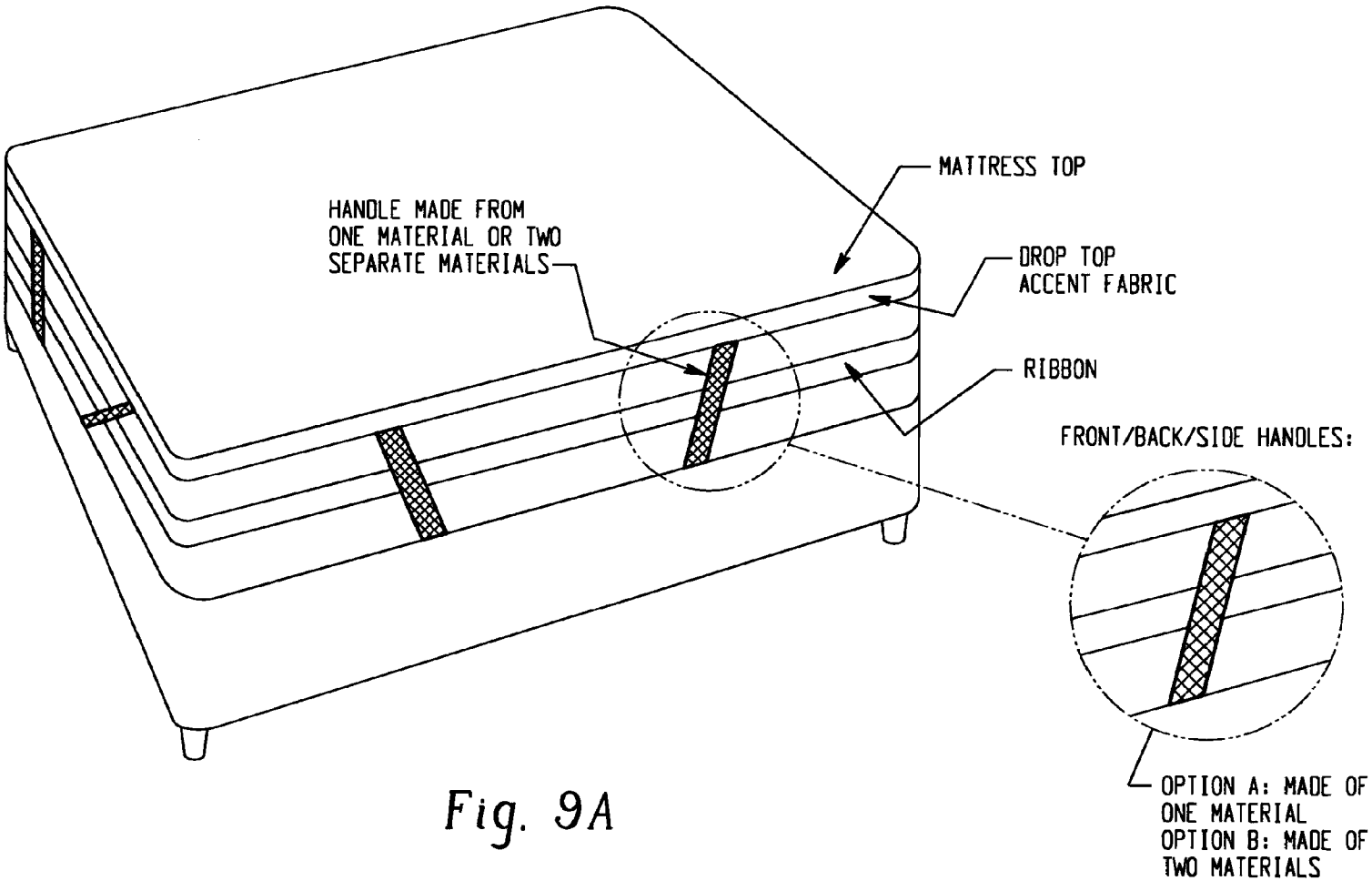
FIGS. 9A-9C depict mattresses having one or more handles depicted in FIGS. 2A-2C, according to an illustrative embodiment of the invention.
Figure 9B:
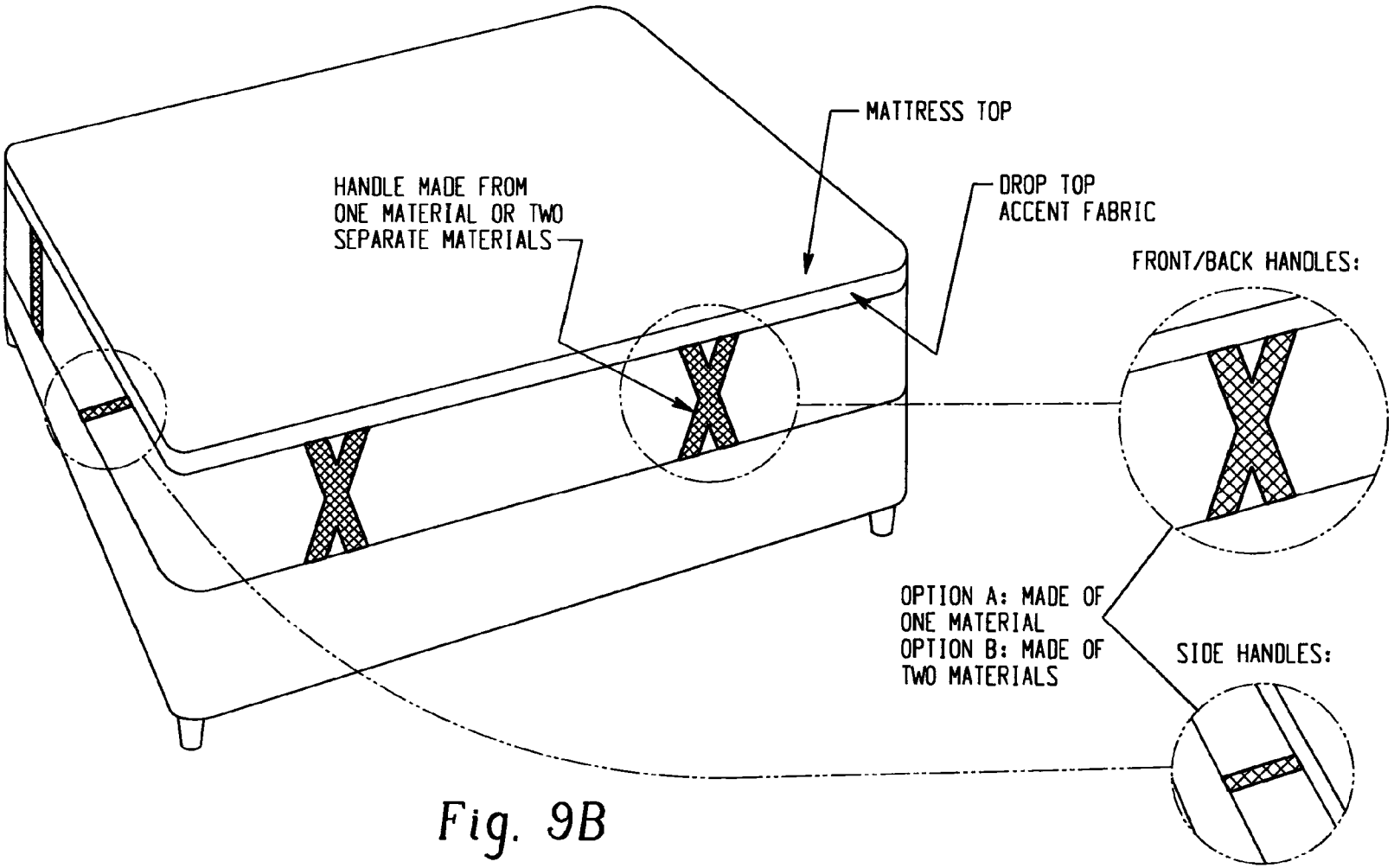
Figure 9C:
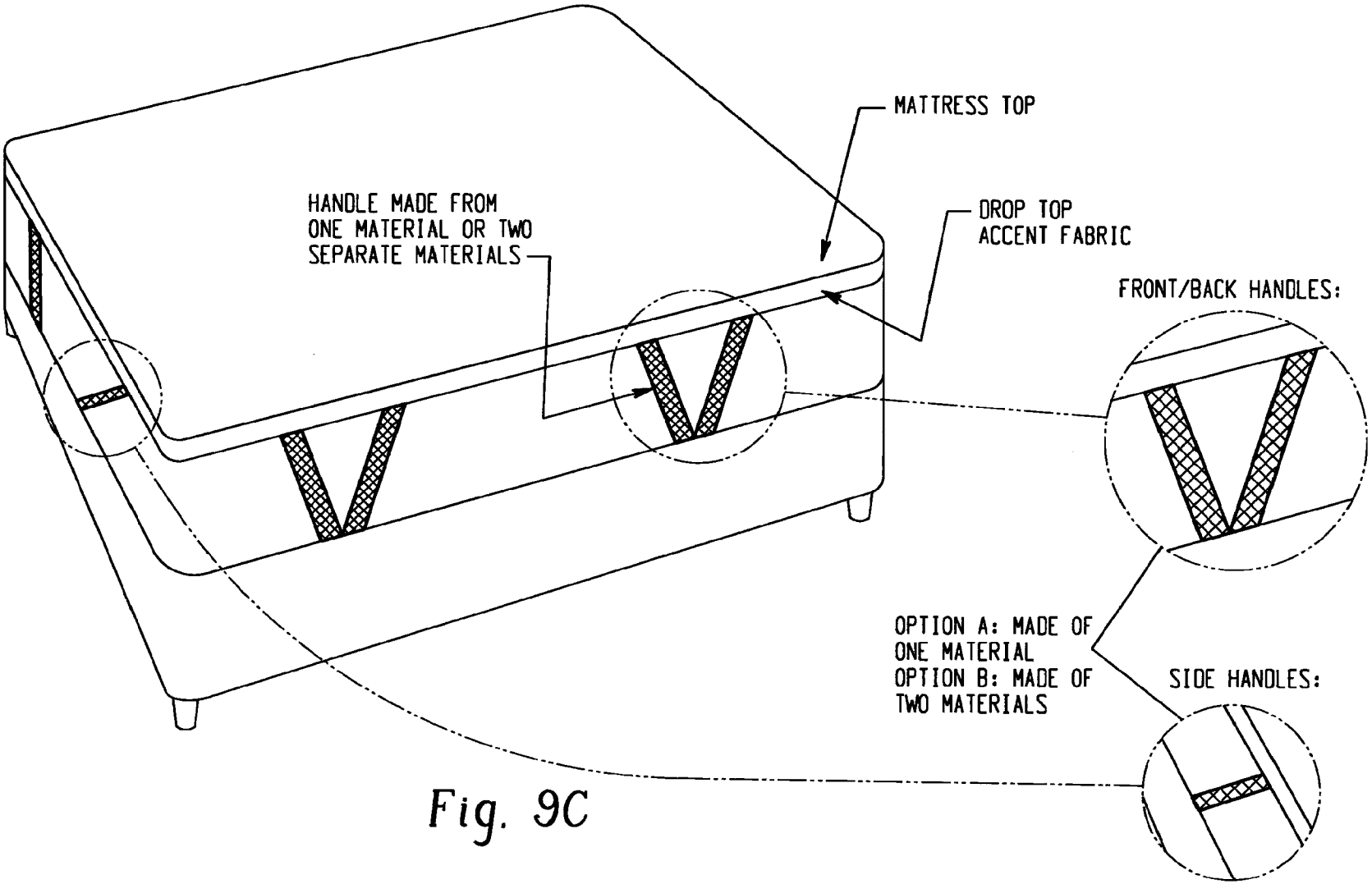

FIGS. 9A-9C depict mattresses having one or more handles depicted in FIGS. 2A-2C, according to an illustrative embodiment of the invention. FIG. 9A shows a mattress having handles of FIG. 2A on at least two side surfaces. In FIG. 9A, the mattress includes a strip of fabric disposed below the top tape edge of the mattress. The handles in FIG. 9A are attached to a portion of this strip of material. The mattress further includes a ribbon material disposed on a center portion of the mattress sidewall. The ribbon material passes underneath the handles. FIG. 9B shows a mattress having handles of FIG. 2B on at least one side surface. In FIG. 9B, the mattress includes a strip of fabric disposed below the top tape edge of the mattress. The handles in FIG. 9B are attached to a portion of this strip of material. The mattress in FIG. 9B further includes the handles of FIG. 2A on at least one side surface. FIG. 9C shows a mattress having handles of FIG. 2C on at least one side surface. In FIG. 9C, the mattress includes a strip of fabric disposed below the top tape edge of the mattress. The handles in FIG. 9C are attached to a portion of this strip of material. The mattress in FIG. 9C further includes the handles of FIG. 2A on at least one side surface.

Figure 3B:
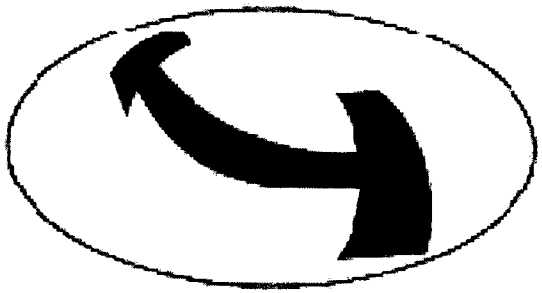
FIGS. 3A-3B depict exemplary curved handles that are disposed on a portion of a mattress
Figure 3A:
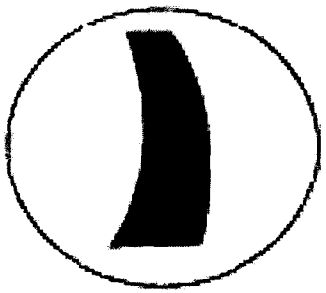

FIGS. 3A-3B depict exemplary curved handles that are disposed on a portion of a mattress. In particular, FIG. 3A shows a single strip of material, FIG. 3B shows two single curved strips of material connected together by a third strip of material.

Figure 10A:
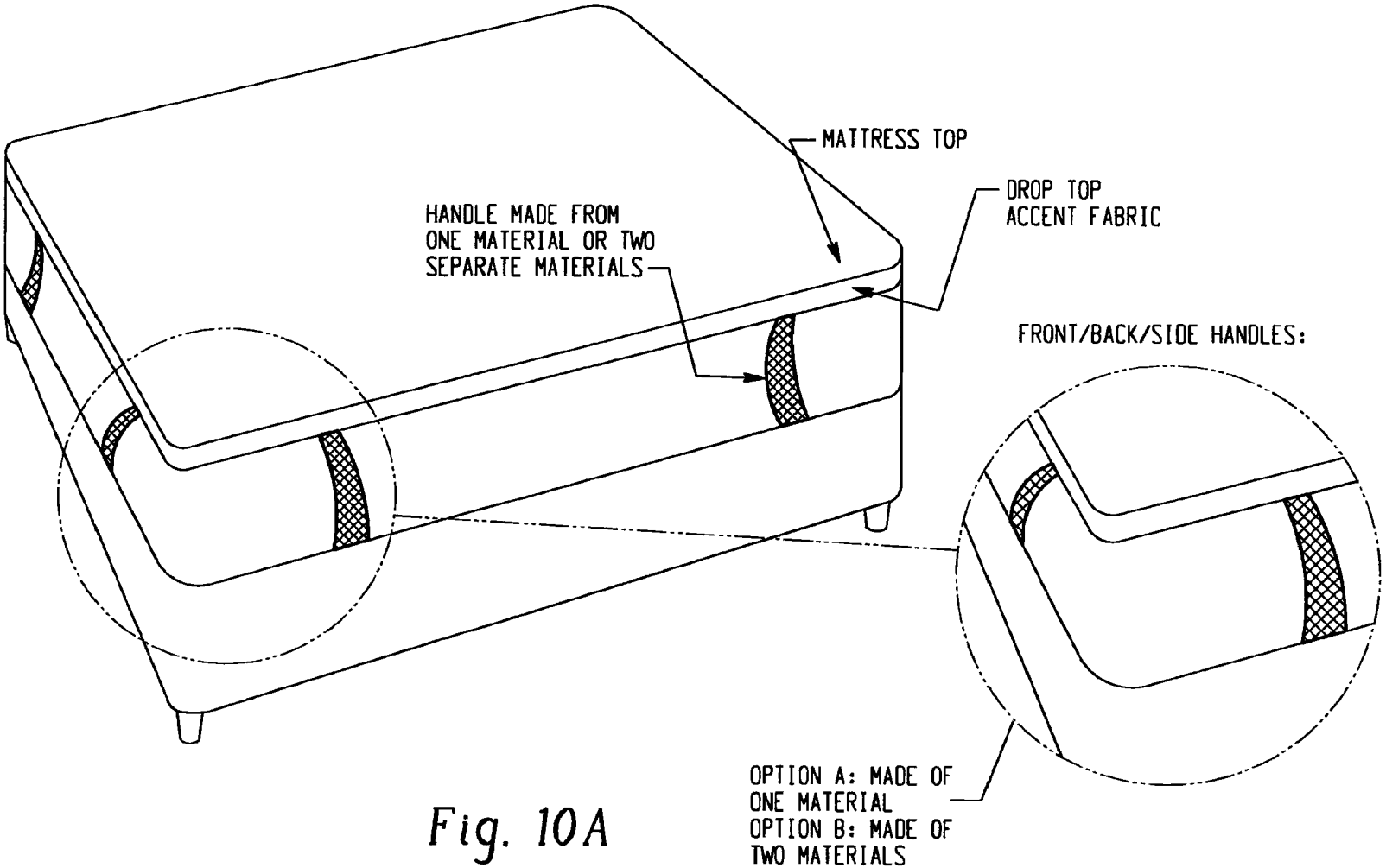
FIGS. 10A-10C depict mattresses having one or more handles depicted in FIGS. 3A-3B, according to an illustrative embodiment of the invention.
Figure 10B:
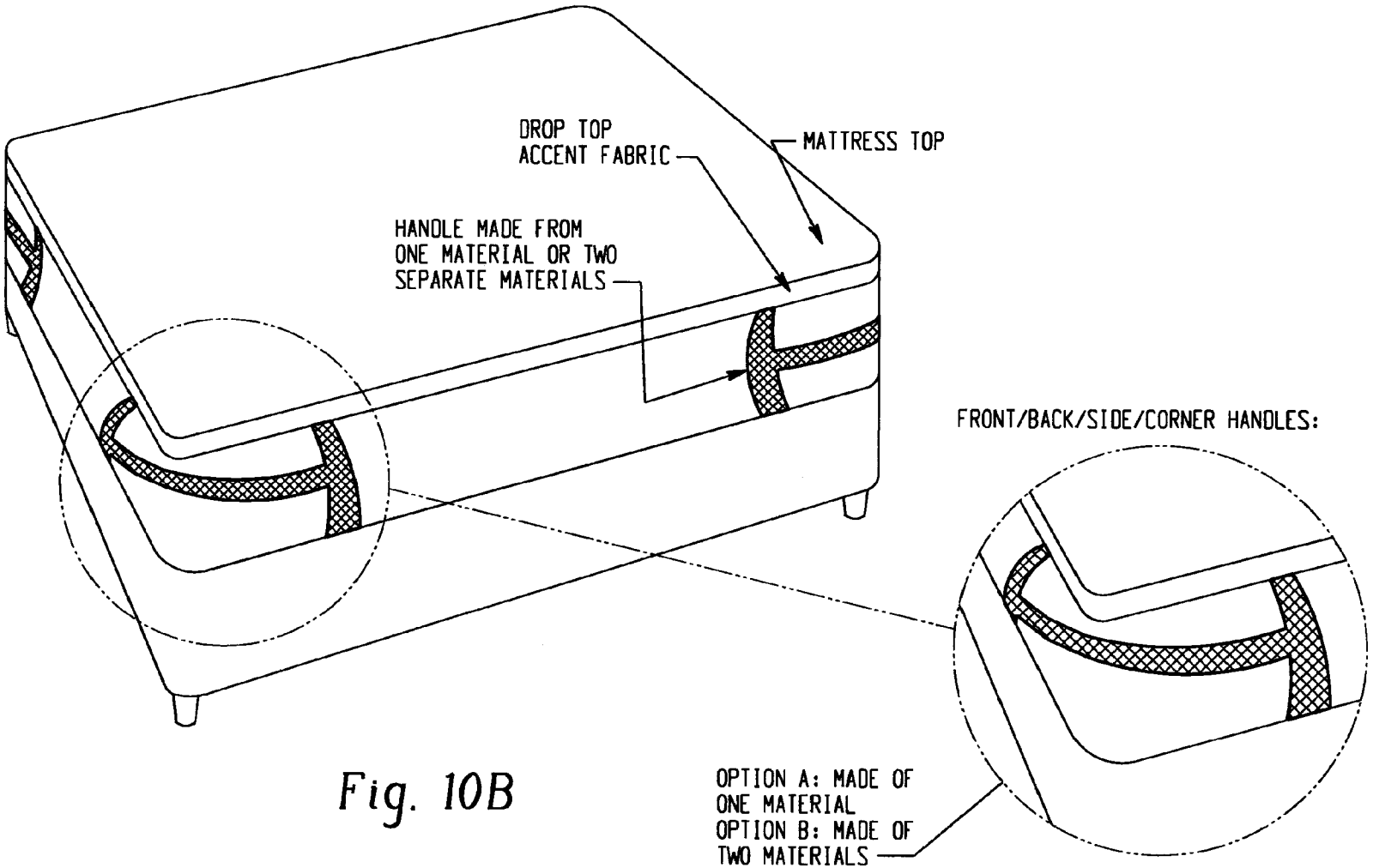
Figure 10C:
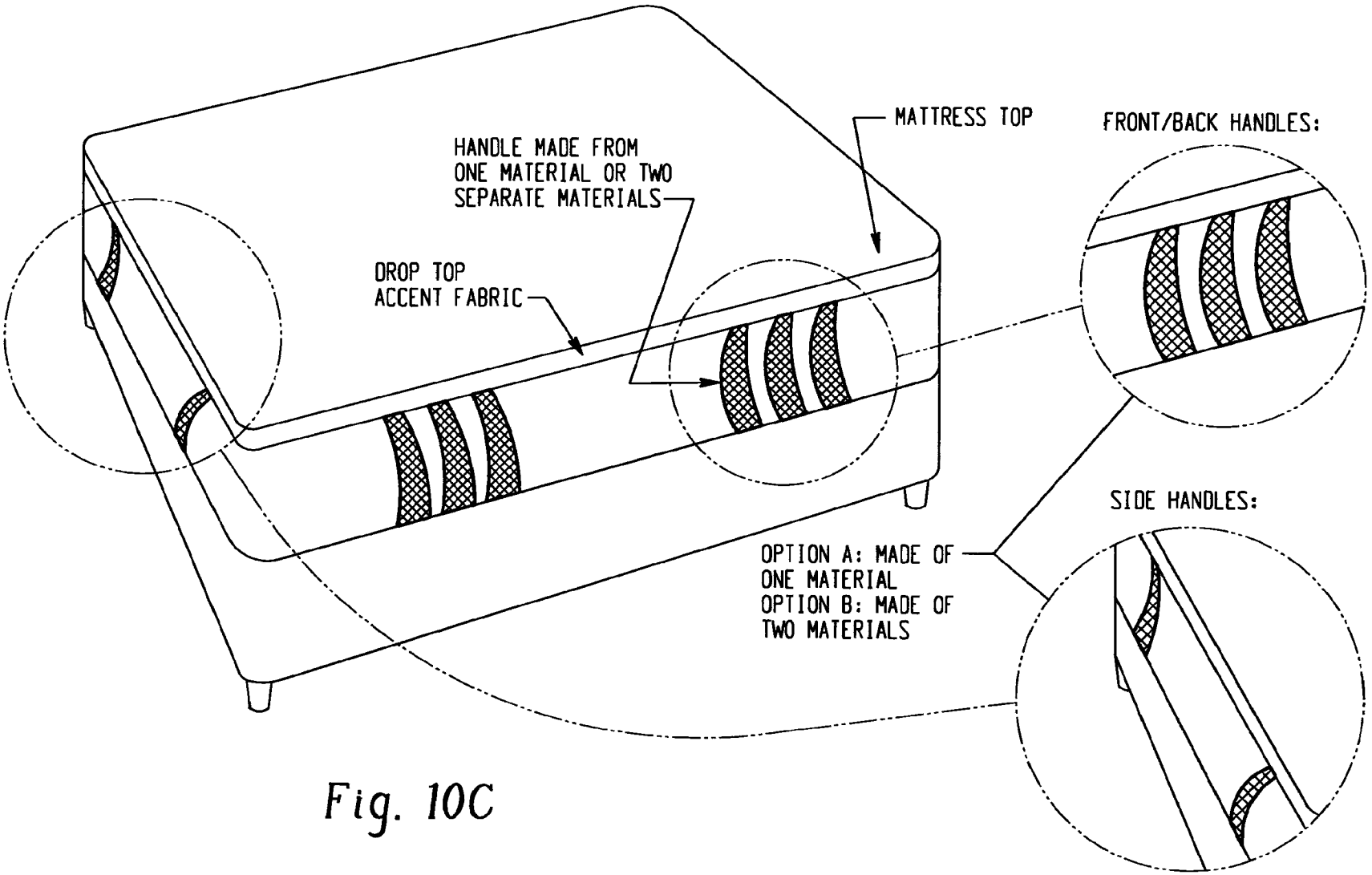
Figure 11A:
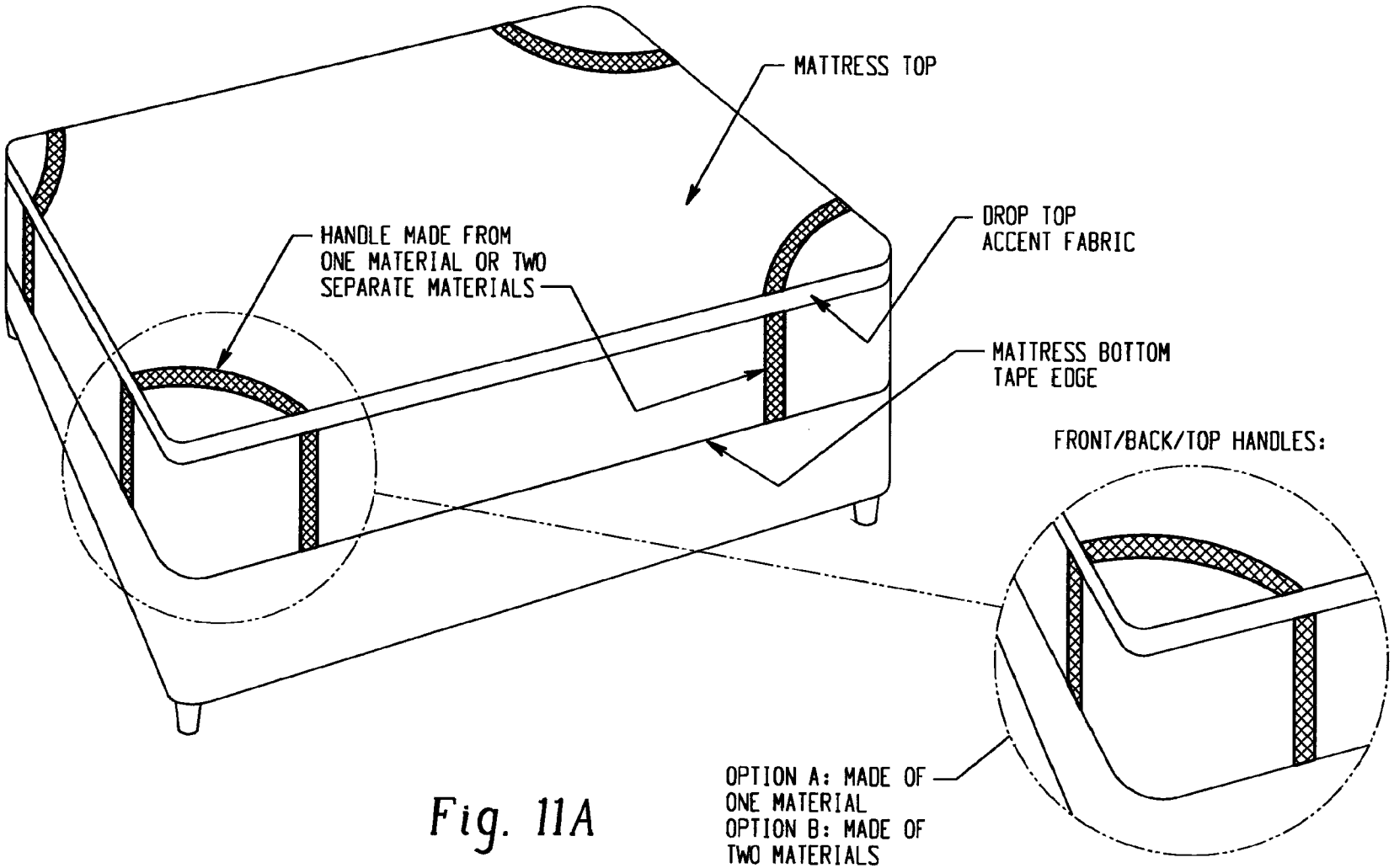
FIGS. 11A-11E depict mattresses having one or more handles depicted in FIGS. 4 and 1-3B, according to an illustrative embodiment of the invention.
Figure 11B:
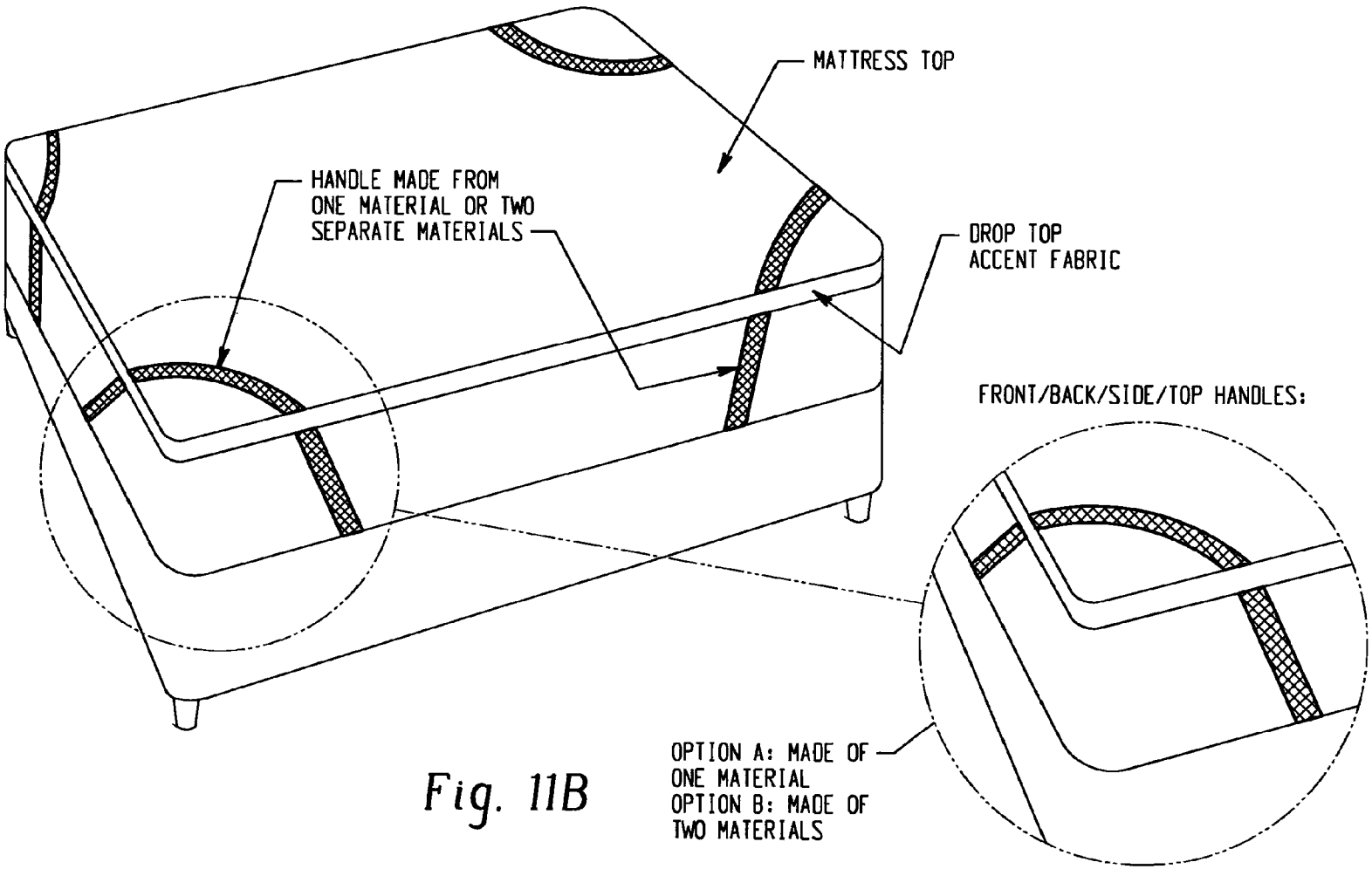
Figure 11C:
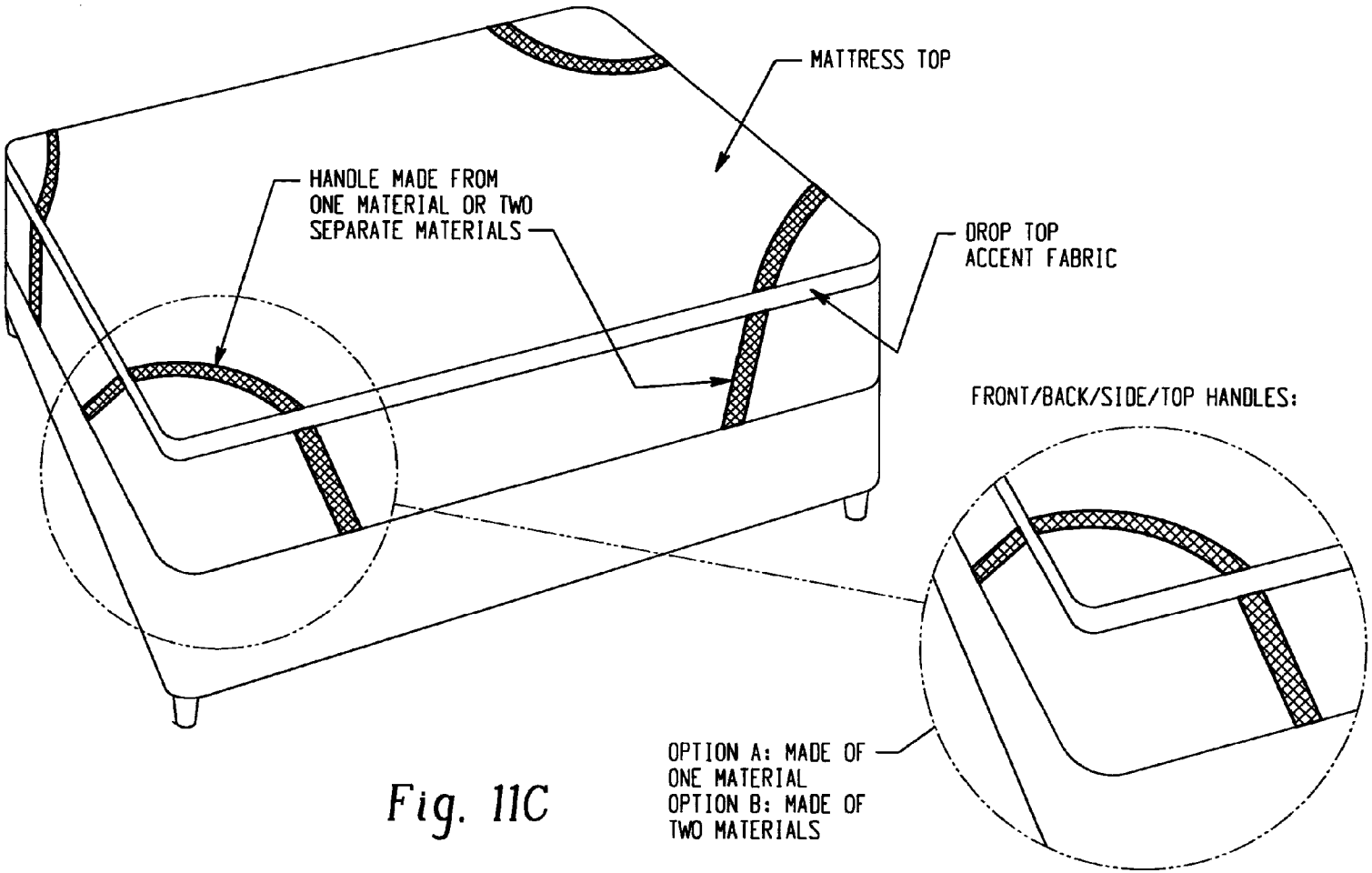
Figure 11D:
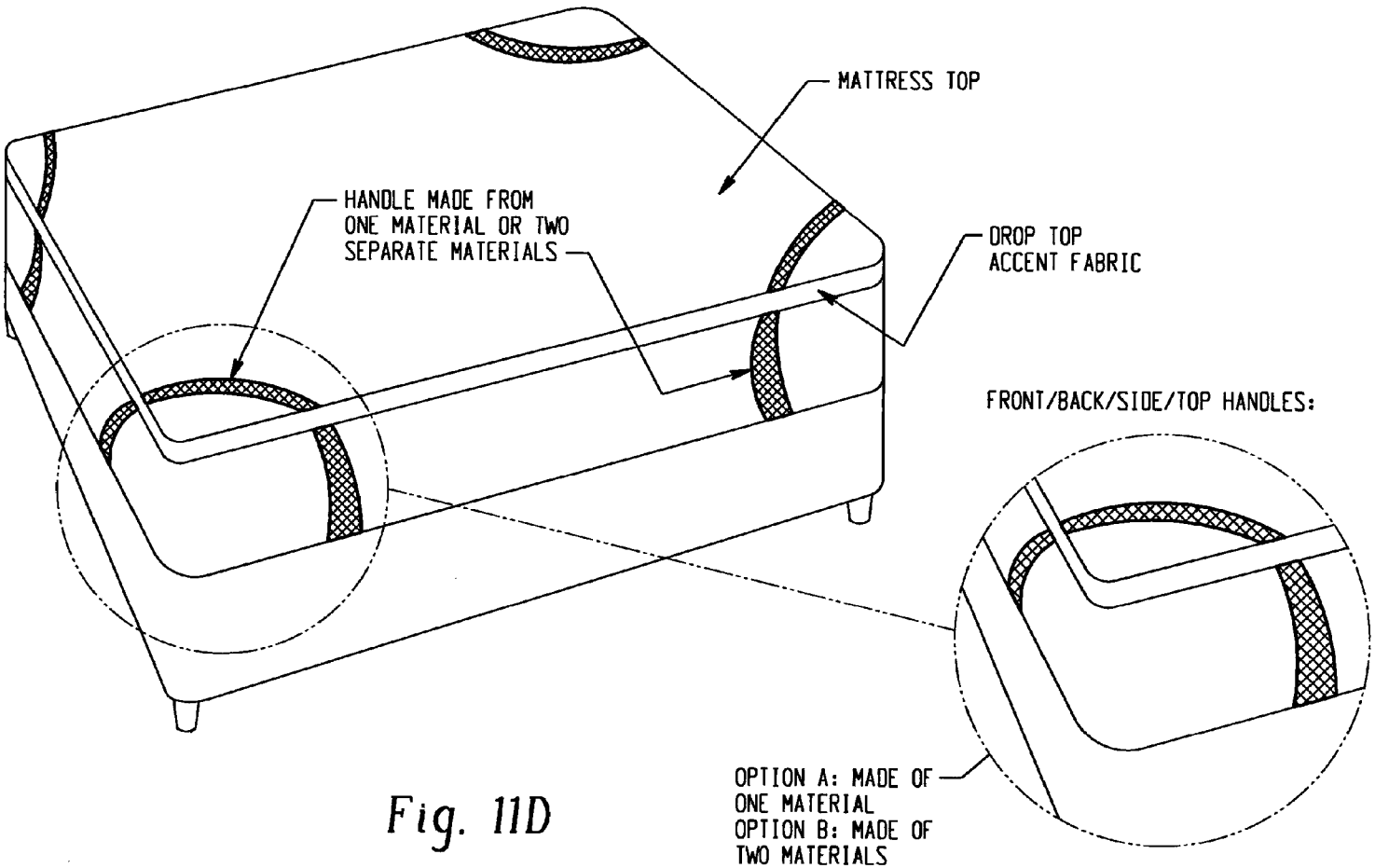
Figure 11E:
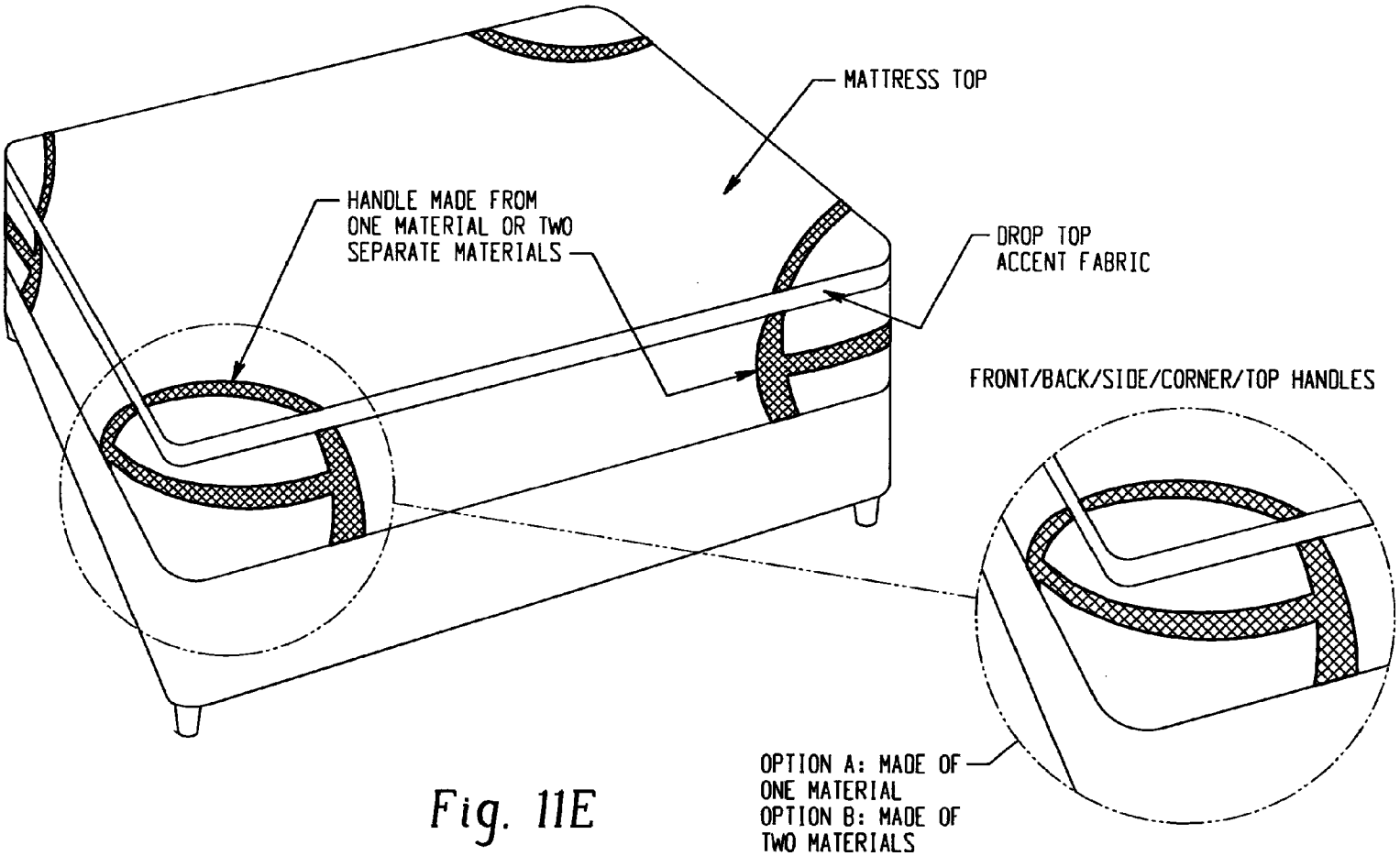

FIGS. 10A-10C depict mattresses having one or more handles depicted in FIGS. 3A-3B, according to an illustrative embodiment of the invention. FIG. 10A shows a mattress having handles of FIG. 3A on at least two side surfaces. In FIG. 10A, the mattress includes a strip of fabric disposed below the top tape edge of the mattress. The handles in FIG. 10A are attached to a portion of this strip of material. FIG. 10B shows a mattress having handles of FIG. 3B on at least two side surfaces. In FIG. 10B, the mattress includes a strip of fabric disposed below the top tape edge of the mattress. The handles in FIG. 10B are attached to a portion of this strip of material. The handles in FIG. 10B are attached along the corner portion of the mattress such that the middle part of each of the handles curves around an edge of the mattress. FIG. 10C shows a mattress having a plurality of closely spaced handles of FIG. 3A on at least two side surfaces. In FIG. 10C, the mattress includes a strip of fabric disposed below the top tape edge of the mattress. The handles in FIG. 10C are attached to a portion of this strip of material.

Figure 4:
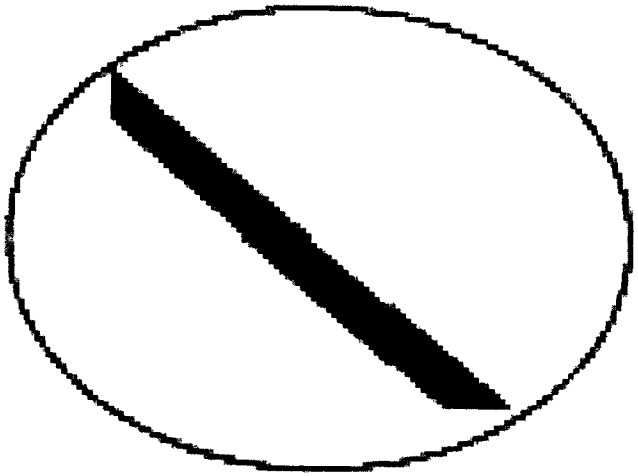
FIG. 4 depicts an exemplary handle that is disposed on a top corner portion of the sleeping surface of a mattress.

FIG. 4 depicts an exemplary handle that is disposed on a top corner portion of the sleeping surface of a mattress. FIGS. 11A-11E depict mattresses having one or more handles depicted in FIGS. 4 and 1-3B, according to an illustrative embodiment of the invention.

Figure 5:
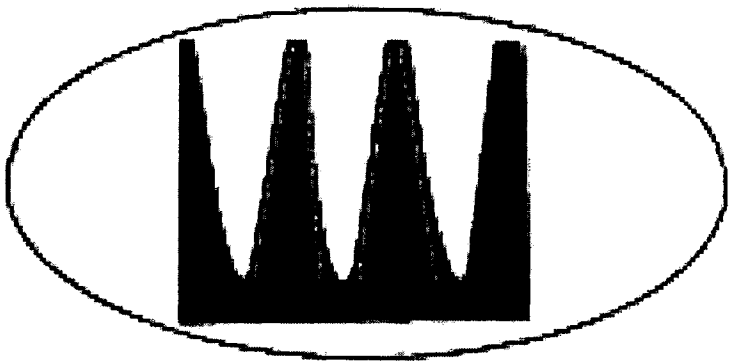
FIG. 5 depicts a set of exemplary handles that are disposed on a side of a mattress.
Figure 12:
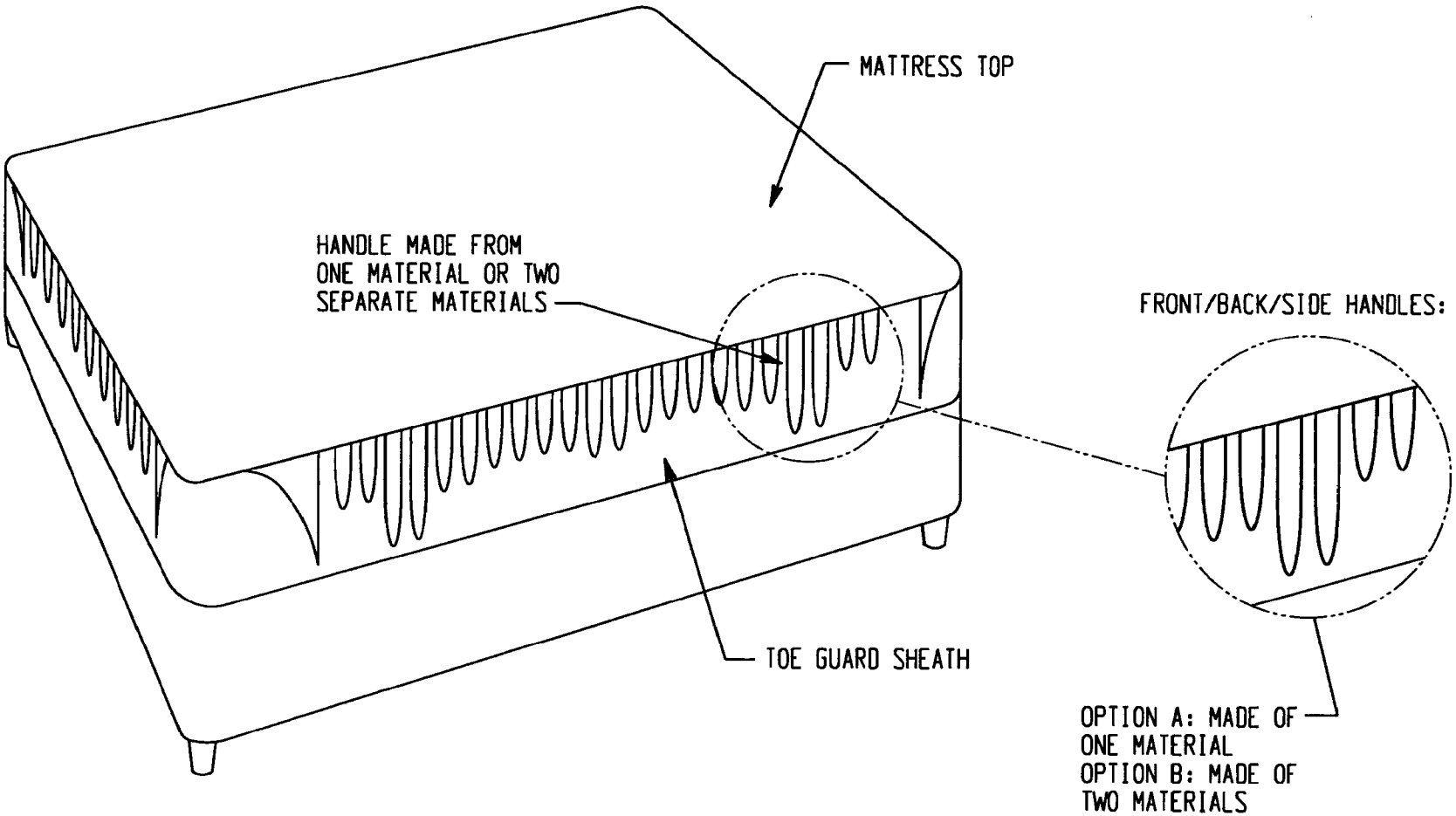
FIG. 12 depicts a mattress having one or more handles depicted in FIG. 5, according to an illustrative embodiment of the invention.

FIG. 5 depicts a set of exemplary handles that are disposed on a side of a mattress. The handles in FIG. 5 may be formed from a fabric or non-fabric material and may be disposed along the sidewall of a mattress. FIG. 12 depicts a mattress having one or more handles depicted in FIG. 5, according to an illustrative embodiment of the invention. The handle depicted in FIG. 5 includes a plurality of fingers. When the handle is attached to the sidewall of a mattress, one or more of these fingers may remain partially unattached. The partially unattached portion may serve as a handle. Accordingly, the mattress of FIG. 12 may include one or more regions configured to serve as a handle.

Figure 6B:
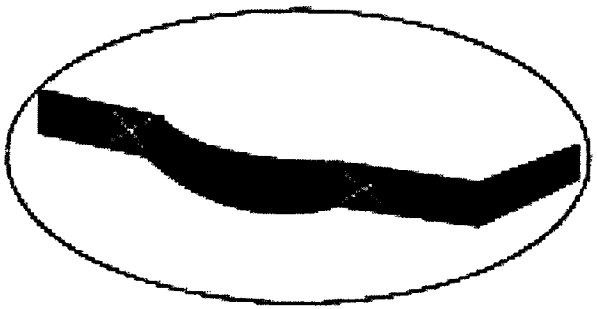
FIGS. 6A-6B depict exemplary handles that are disposed in a horizontal orientation on a portion of a mattress.
Figure 6A:
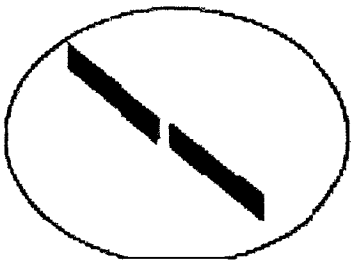

FIGS. 6A-6B depict exemplary handles that are disposed in a horizontal orientation on a portion of a mattress. FIG. 6A shows two strips of materials positioned along a similar horizontal line with one another. FIG. 6B shows a horizontal ribbon-like material configured as a band running around the mattress on sidewall. The handle of FIG. 6B may be attached and unattached along select portions, thereby forming one or more handles as desired on the mattress sidewall.

Figure 13A:
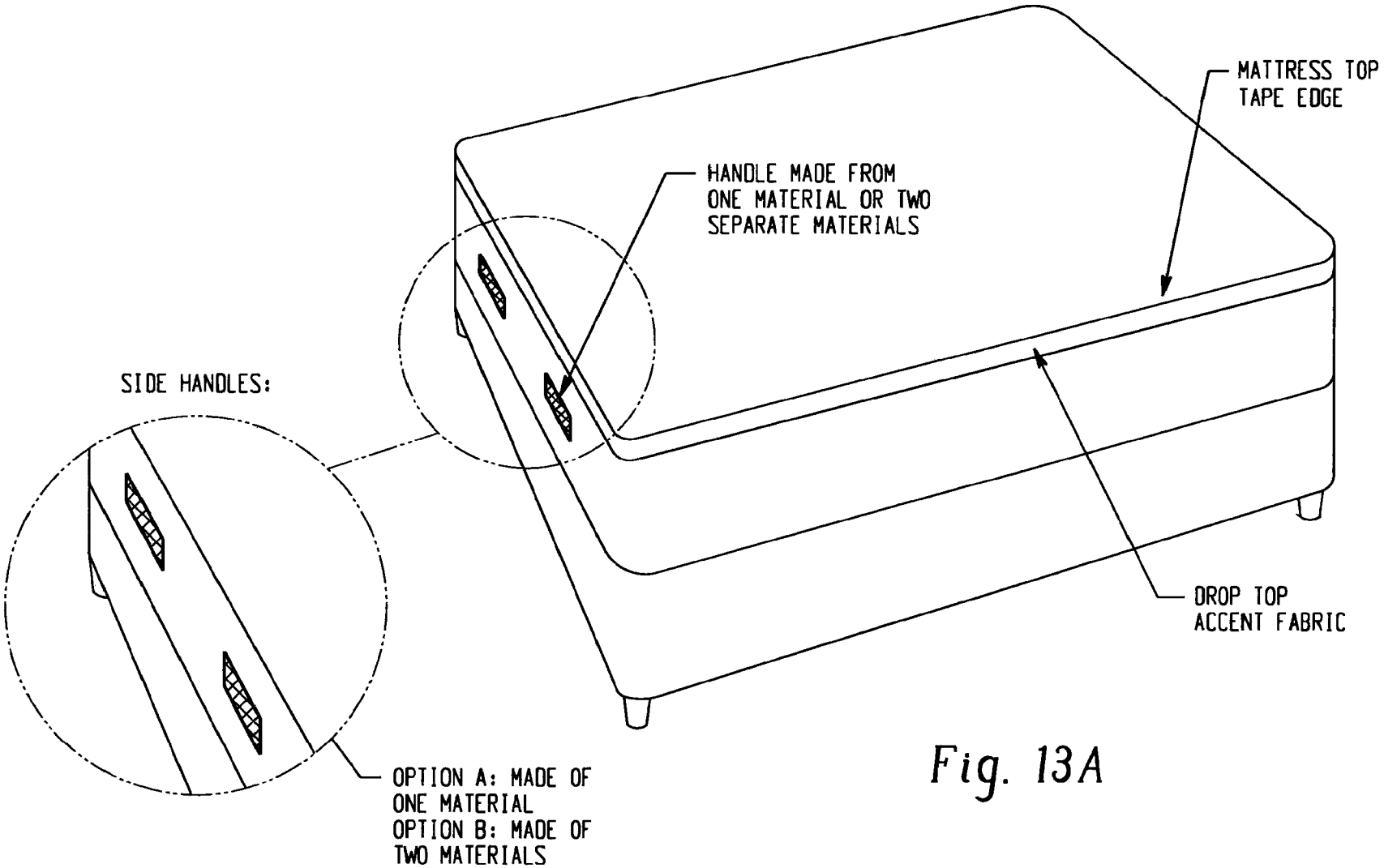
FIGS. 13A-13B depict mattresses having one or more handles depicted in FIGS. 6A-6B, according to an illustrative embodiment of the invention.
Figure 13B:
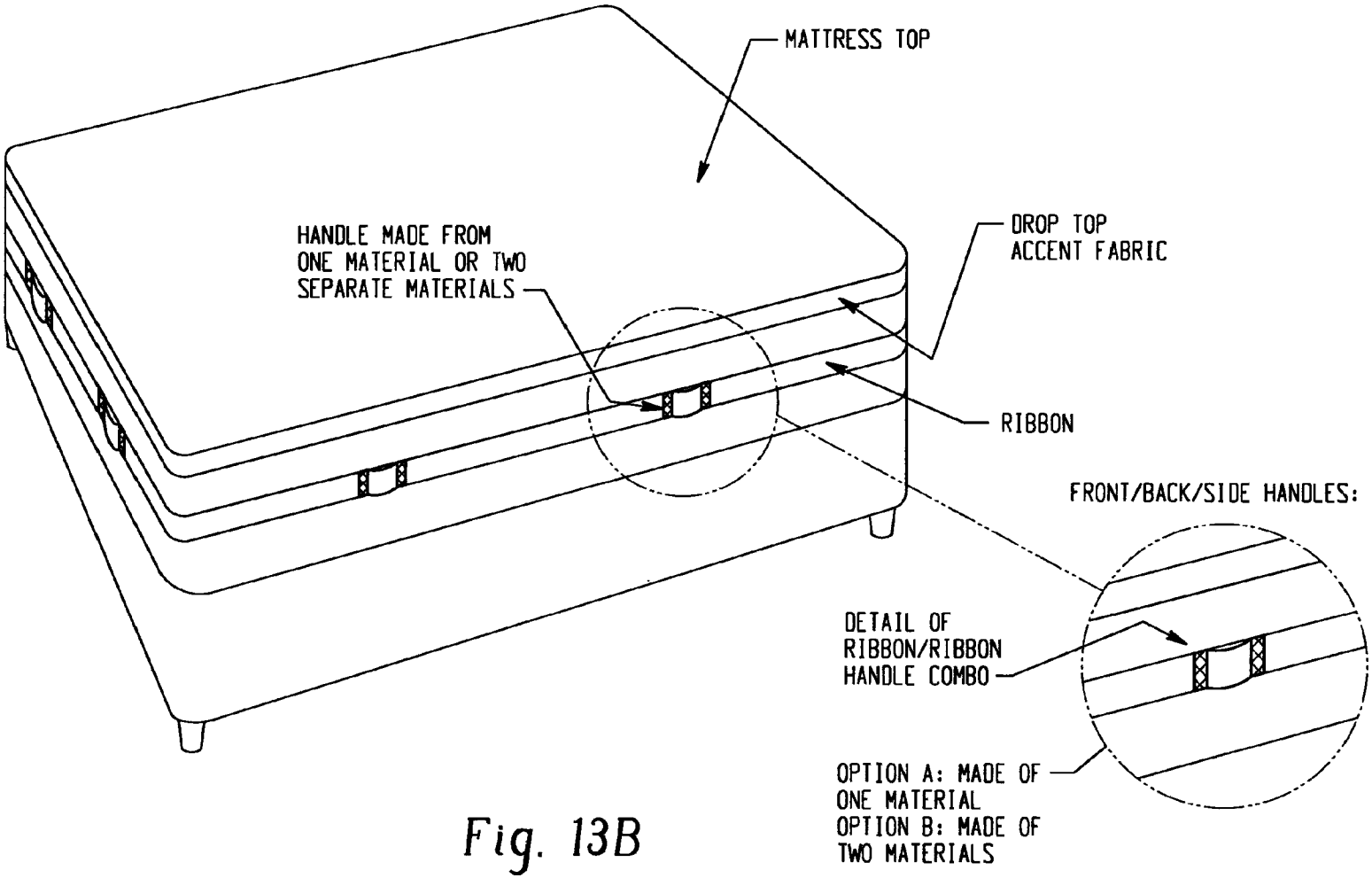

FIGS. 13A-13B depict mattresses having one or more handles depicted in FIGS. 6A-6B, according to an illustrative embodiment of the invention. FIG. 13A shows a mattress having handles of FIG. 6A on or more side surfaces. The handle may be attached on or substantially near a top, center or bottom portion of a sidewall of the mattress. FIG. 13B shows a mattress having handles of FIG. 6B on or more side surfaces. The mattress includes a ribbon-like material running about the mattress along a center portion of the sidewall. One or more handles are formed by stitching select portions of the ribbon-like material to the sidewall, while leaving other portions unattached.

Figure 7:
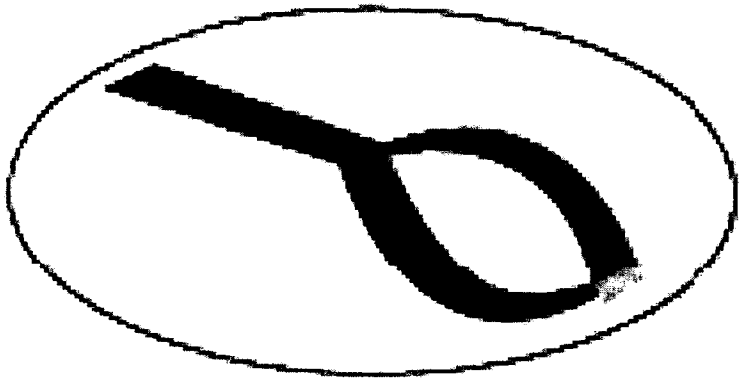
FIG. 7 depicts an exemplary handle that is disposed under a mattress.
Figure 14:
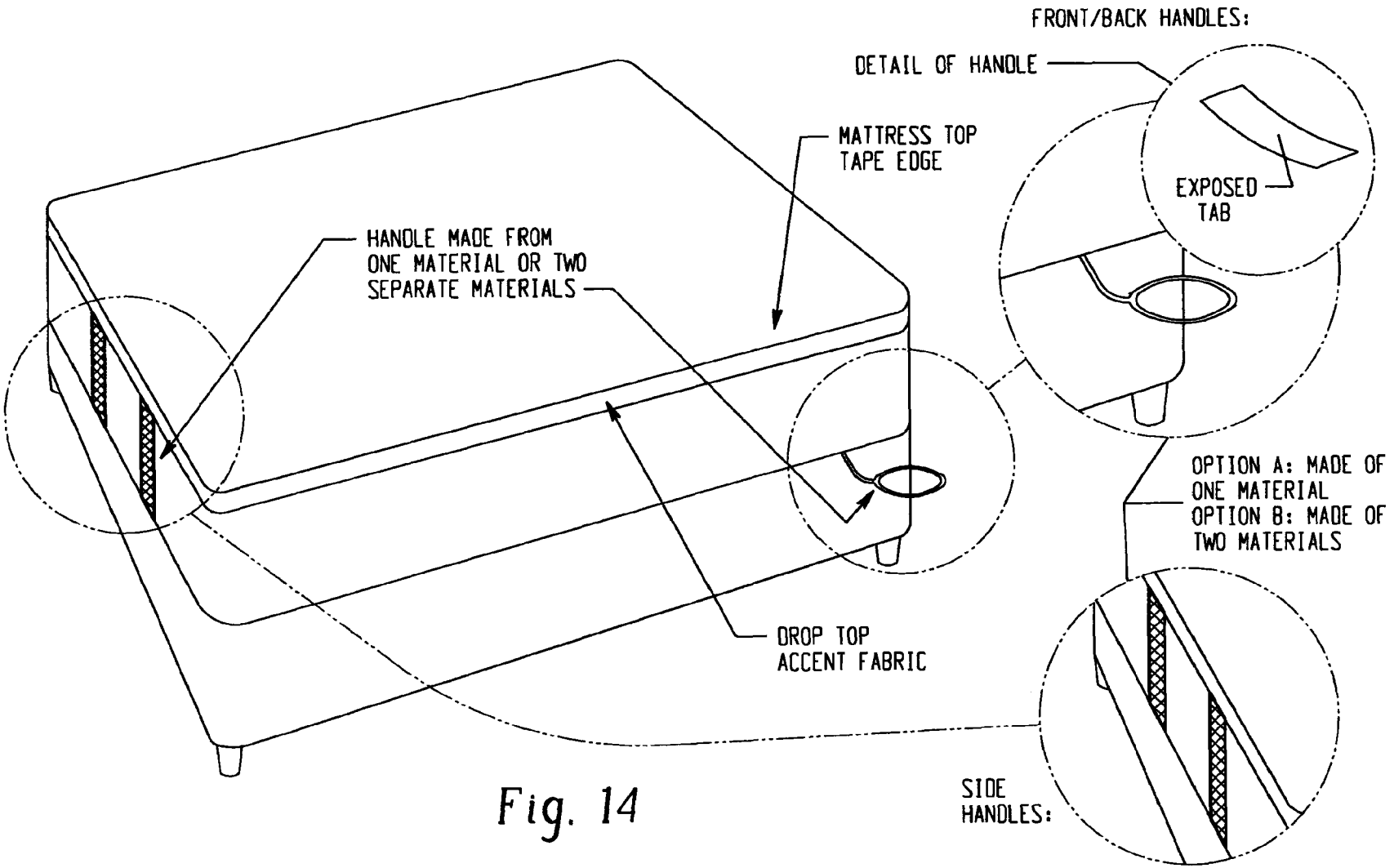
FIG. 14 depicts a mattress having one or more handles depicted in FIG. 7, according to an illustrative embodiment of the invention.

FIG. 7 depicts an exemplary handle that is disposed under a mattress. FIG. 14 depicts a mattress having one or more handles depicted in FIG. 7, according to an illustrative embodiment of the invention. The handle of FIG. 7 includes a loop of material connected to a strap. The strap may be disposed under the mattress and attached to portion of the bottom surface. The loop portion may be tucked underneath the mattress when the handle is not in use. As desired, the loop may be pulled out from underneath the mattress and used to lift and move the mattress. In certain embodiments, the loop includes a tab portion extending outwardly from the loop and away from the strap. When the loop is tucked under the mattress, the tab may extend out of the mattress and may help locate the loop and extract it from under the mattress.

Therefore, it may be seen that, among other things, a furniture handle, and in particular handle for a mattress, is provided which provides improved usability and manufacturability. While the systems and methods have been described in specific detail with reference to the disclosed embodiments, it will be understood that many variations and modifications may be effected within the spirit and scope of the invention as described in the appended claims. For example, the mattresses may have two or more handles, located a different positions on the mattress. The handles may be provided on mattresses and other cushions, as well as on foundations, and other furniture frames that are typically upholstered, to provide these frames with an easy to use handle. The handles described herein may be used with any type of mattress, including a foam core mattress, or a mattress having a combination of foam and springs. The mattress may be onesided or two-sided, and the number of handles provided may vary based on the number of sleeping surfaces of the mattress. In light of all that is disclosed above, those skilled in the art will know or be able to ascertain using no more than routine experimentation, many equivalents to the embodiments and practices described herein.

The invention claimed is:

1. A bedding system comprising:

a mattress having a sleeping surface, a bottom surface, and a plurality of sidewalls extending between the bottom and sleeping surfaces; and one or more pullout handles, each pullout handle comprising a strap having a proximal end fixedly attached to the bottom surface and a distal end free of any attachment to the mattress defining a looped portion, wherein each pullout handle is configured such that during use the looped portion can extend outwardly in a spaced relationship from at least one of the plurality of sidewalls, and inserted underneath the bottom surface when not in use.

2. The bedding system of claim 1, wherein the pullout handle is disposed at about a corner of the mattress.

3. The bedding system of claim 1, further comprising a tab portion extending outwardly from the loop portion.

4. The bedding system of claim 3, wherein the tab is configured to extend outwardly from a respective one of the plurality of sidewalls.

* * * * *